United States Patent [19]

Jones et al.

[11] 4,114,333

[45] Sep. 19, 1978

[54] WALL PANEL UNIT

[76] Inventors: Harold E. Jones, 4901 Minneapolis Ave., Mound, Minn. 55364; Donald T. Ottenweller, 4285 Circle Dr., Wayzata, Minn. 55391

[21] Appl. No.: 784,690

[22] Filed: Apr. 5, 1977

[51] Int. Cl.[2] ..... E04B 2/04; E04C 2/24; E04C 2/36

[52] U.S. Cl. ..... 52/265; 52/281; 52/309.11; 52/461; 52/586; 52/593; 52/741

[58] Field of Search ..... 52/589, 593, 309.9, 52/309.10, 309.14, 309.12, 619, 620, 615, 461, 281, 741, 586

[56] References Cited

U.S. PATENT DOCUMENTS

| | | | |
|---|---|---|---|
| 2,412,242 | 12/1946 | Beaud | 52/461 |
| 2,911,076 | 11/1959 | Saunders | 52/619 |
| 3,236,014 | 2/1966 | Edgar | 52/593 |
| 3,462,897 | 8/1969 | Weinrott | 52/309.11 |
| 3,471,984 | 10/1969 | Hayes | 52/309.11 |
| 3,640,039 | 2/1972 | McKee | 52/586 |
| 3,683,569 | 8/1972 | Holm | 52/309.11 |
| 3,719,016 | 3/1973 | Randolph | 52/309.9 |
| 3,866,370 | 2/1975 | Guarino | 56/615 |

FOREIGN PATENT DOCUMENTS

| | | | |
|---|---|---|---|
| 951,866 | 7/1970 | Canada | 52/620 |

OTHER PUBLICATIONS

"The Wall" by Jones & Ottenweller, Mound, Minn., 55364, 14 pages, copyright 1974.

*Primary Examiner*—John E. Murtagh
*Attorney, Agent, or Firm*—Shoemaker and Mattare, Ltd.

[57] ABSTRACT

A load bearing wall panel unit is comprised of a pair of facially opposed co-extensive panels connected together by edge fasteners and has a core of foam-like material located between the panels. The unit has an outer layer of weatherproofing material and is connected to adjacent units by tongue and groove fasteners. Tongue and groove fasteners are also used to connect the units to a building foundation and roof.

24 Claims, 10 Drawing Figures

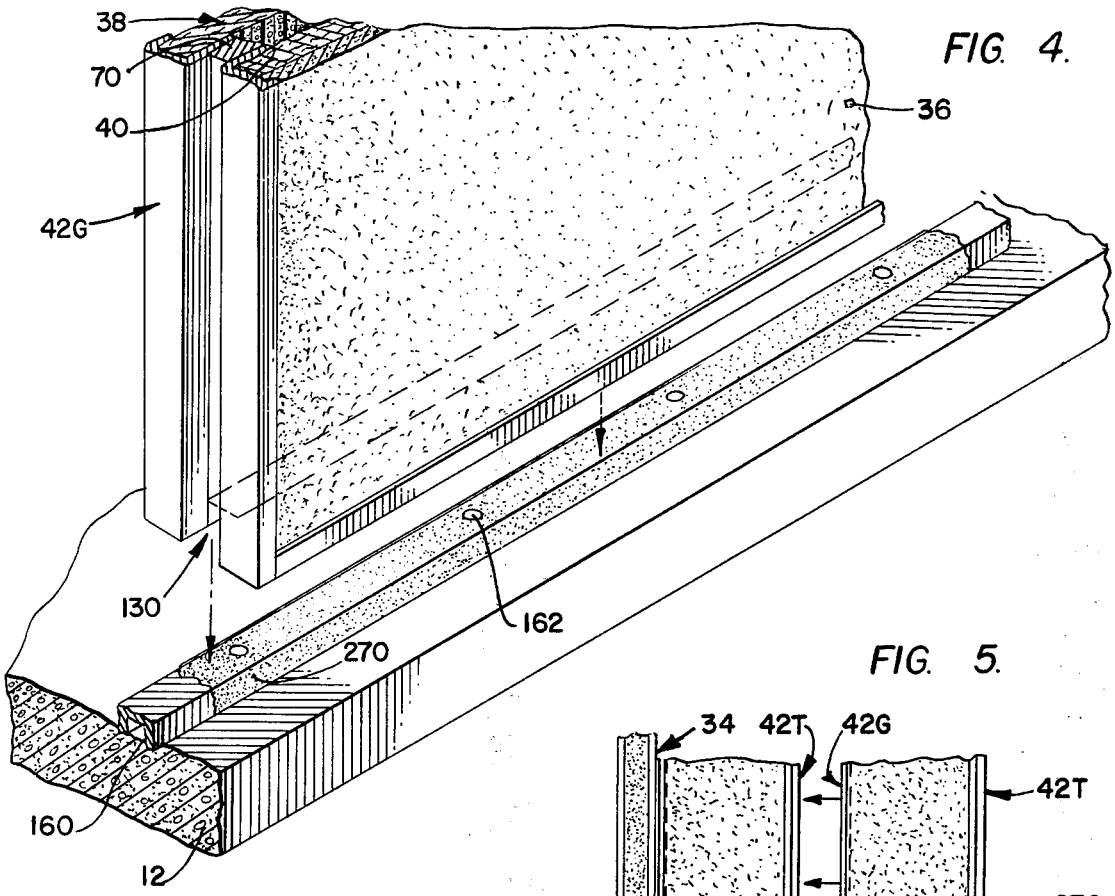
FIG. 4.
FIG. 5.
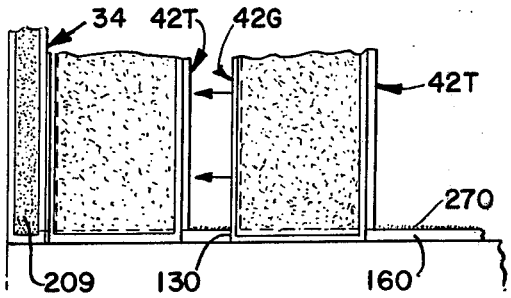
FIG. 6.
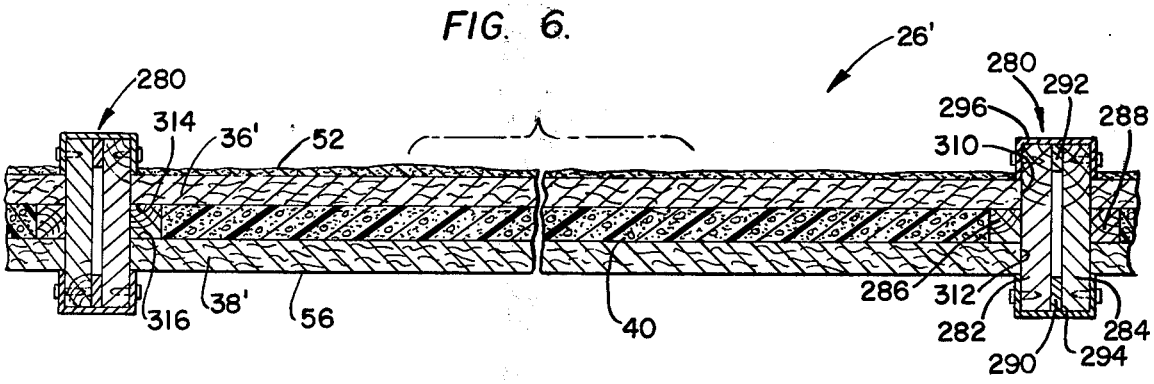

WALL PANEL UNIT

BACKGROUND OF THE INVENTION

The present invention generally relates to building structures, and more particularly, relates to building wall panels.

The walls of many modern buildings are formed by interconnecting a plurality of units together to form the desired matrix. These units are often preassembled and shipped to the building site to be connected together to form the building walls. Examples of such wall units are the precast concrete units and the curtain wall units. The curtain wall construction is non-load bearing, and the precast concrete wall is very heavy and difficult to ship and install.

The acoustical and thermal properties of these known wall panels have fallen short of requirements, and, accordingly, new forms of wall panels are required to meet modern building requirements. In fact, many prefabricated walls have not been designed with acoustical considerations in mind at all, and furthermore, many of the known panels require special caulking.

Some precast concrete panels have foam added to them to improve thermal properties of those panels. However, such constructions have not been entirely satisfactory, especially from the standpoint of thermal insulation properties.

The present invention is embodied in a load bearing panel unit which is a very good acoustical and thermal insulator as compared to known constructions.

SUMMARY OF THE INVENTION

The present invention provides a wall formed of a plurality of load bearing panels.

In general, the invention is embodied in a unit having a layer of waterproof coating placed on at least one surface of an acoustical panel which is coupled with another acoustical panel and has a foam core located between the two panels to form a self- and load-supporting wall panel unit. More specifically, each unit embodying the teaching of the present invention has a pair of co-extensive panels oriented to be in spaced parallelism and have a core of foam material located therebetween. A frame construction is located around the peripheral edge of each unit and includes a tongue fastening means which is located on one unit side edge and a groove fastening means which is located on the other side edge of the panel unit. Tongue and groove fastening means are also located on the top and bottom edges of the unit to engage corresponding groove and tongue fastening means on super and subjacent units. Corresponding tongue and groove fastening means on adjacent units are coupled together to interlock the wall units with each other and to the building structure.

The bottom fastening means is adapted to cooperate with a furring strip-like element attached to the building foundation or to the building floor for attaching the lowermost row of units to the building foundation.

The fastening means include of pair of J-shaped channel forming members connected together by wood strips. The wood strips used in the groove fasteners are located beneath the plane of the wall unit edge, and the wood strips used in the tongue fasteners project outwardly beyond that plane for insertion into a groove to couple two panel units together.

An alternative embodiment of the present invention has an abutment joint including a pair of cross members with spacer members interposed therebetween, with the cross members being held together by a U-shaped cap. The cross members are each attached to a panel unit and connect those units together via the U-shaped cap.

Wall corner units include a corner element surrounded by channel elements and formed to have tongue and groove edge fastening means thereon for connecting the panel units to the corner unit. Top and bottom fastening means are also located on the corner units. The corner units are also load bearing.

Wall construction is simple and can be carried out using fully assembled panel units, or disassembled panel units, as suitable.

If fully assembled panel units are used, the units are mounted on the furring strip which is covered by a suitable adhesive means, and connected together by suitable sealer means after having been slidably moved into the desired positions.

If the panels units are assembled in situ, the bottom fastening means are mounted on the furring strip, then the edge channels are connected thereto, and to each other, using sealer means. The panels are slidingly engaged in the fastener channels and the foam core is inserted or foamed in the space between the panels. The top fastening means are positioned, and the next row of panel units, or roof, is erected.

The uppermost tongue is cut off flush with the top surface of a panel unit and a weight distributing member is connected to the tongue by nails, or the like. The roof members are then fastened to the wall via the weight distributing member.

A layer of weatherproofing is positioned on an exterior surface, and a layer of decorative wall surfacing may be, but preferably is not, positioned on an interior surface of the panel unit.

In the preferred embodiment, the panels are formed of PetriCal, a trademark for an acoustical insulating panel manufactured by Cornell Corporation of Cornell, Wisconsin, the foam core is comprised of urethane foam and the weatherproofing layer is Thoroseal, a trademark for a product manufactured by Standard Dry Wall Products, Inc. of Miami, Fla.

The panel construction of the present invention has excellent thermodynamic characteristics and does not require special caulking materials. The panel also exhibits excellent acoustical characteristics, such as low level sound transmission and high level sound absorption.

The units are of variable size, completely interchangeable and can also be used to erect temporary structures due to the ease with which the walls are assembled.

There is no continuous path of metal through the wall, as the wood members used to connect the fastener channels together interrupt that path. Furthermore, there are a plurality of surfaces comprised in the panel units which further increases the resistance to heat flow through the panel unit. Thus, heat transfer through a wall formed of the panel units embodying the present invention is slower than in presently known units.

The units of the present invention are also lightweight in comparison to presently known units, and thus result in savings in cost, labor and shipping over those factors associated with known units.

OBJECTS OF THE INVENTION

Accordingly, it is a main object of the present invention to provide a load bearing wall panel unit which has good acoustical and thermal characteristics.

It is another object of the present invention to provide a load bearing wall panel unit which is light in weight.

It is a further object of the present invention to provide a load bearing wall panel unit which does not require special caulking.

It is a more specific object of the present invention to provide a load bearing wall panel unit which has no direct metal path between the inside and outside surfaces thereof.

These together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

FIG. 4 is a perspective view of a panel end.

FIG. 5 is a fragmentary elevation view of a panel end.

FIG. 6 is a plan view of an alternative embodiment of the present invention.

DETAILED DESCRIPTION OF THE INVENTION

Figure 1:
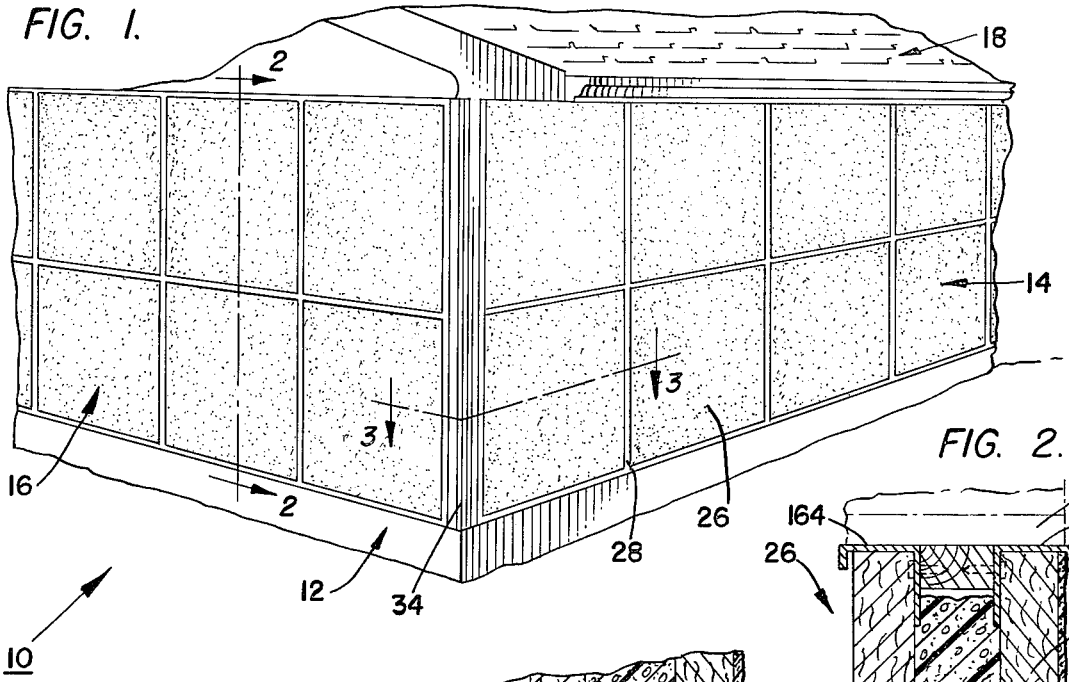
FIG. 1 is a perspective view of a building utilizing the wall panel unit embodying the teachings of the present invention.

Shown in FIG. 1 is a building 10 constructed using the wall panel unit structure embodying the teachings of the present invention. In general, the building includes a foundation 12 supporting side walls 14, end wall 16 and a roof 18. The foundation and roof are of the usual construction and, therefore, will not be discussed.

The walls are formed of a plurality of planar units 26 connected together at joints 28 to form a side wall matrix and an end wall matrix connected together by corner elements 34.

Figure 2:
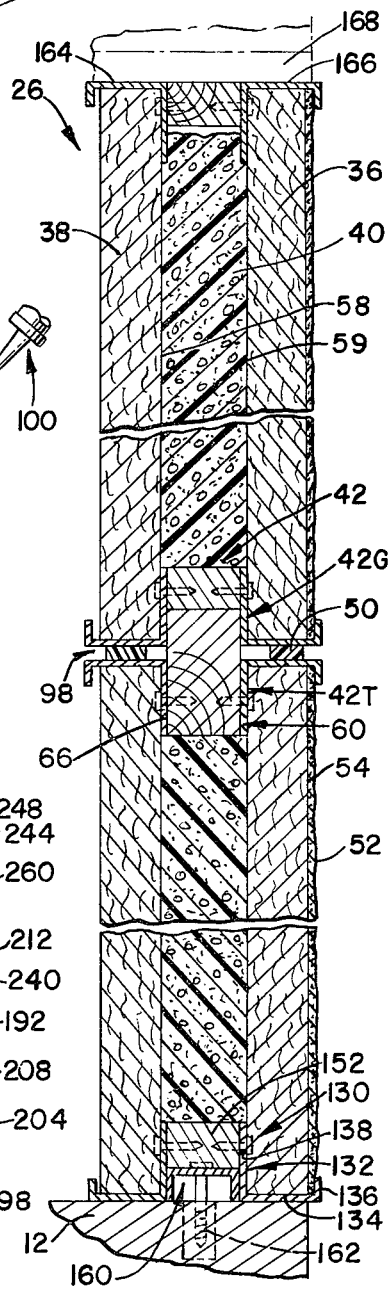
FIG. 2 is a vertical section along line 2—2 of FIG. 1.

As shown in FIG. 2, each unit 26 is of sandwichlike construction and is comprised of an exterior panel 36 and an interior panel 38 connected together by a core 40 and oriented to be in spaced parallelism with respect to each other. The panels can be manufactured of cementitious materials. Peripheral frame elements 42 act as fasteners to connect the panels together with the core therebetween. The fasteners 42 also act as load bearing elements and will be discussed in greater detail below. Sealant, such as caulking 50, connects adjacent panels together in a weathertight manner. A layer of water- or weather-proofing material 52 is located on the outer face 54 of exterior panel 36.

In the preferred embodiment, the panels are formed of PetriCal, a product manufactured by Cornell Corporation of Cornell, Wisconsin, which comprises chemically treated long tough northern aspen wood fibers bound with Portland Cement. The fibers and cement are mixed together and molded under pressure, and cured and kiln dried. The complete description of the PetriCal material and the properties thereof is contained in a brochure dated 1976 and identified as Cementitious Deck, Cement-fiber decking 3, 3.4/Cor, published by Cornell Corporation.

Also in the preferred embodiment, the core material is comprised of urethane or polyurethane foam which is poured, sprayed or frothed into the interstice between the panels and binds itself thereto upon drying.

The interfaces 58 and 59 between the core and the panels are shown in the figures to be distinct, but in actuality are less well defined due to the fibrous nature of the panels. However, the interfaces are shown to be well defined merely for the purposes of clarity.

The outer layer of weatherproofing material 52 is preferably comprised of Thoroseal, a product manufactured by Standard Dry Wall Products of Miami, Fla. The Thoroseal material is a cement-base aggregate type waterproof coating with aggregates graded and sized as suitable. Thoroseal also comes in a variety of colors. A complete description of the Thoroseal product is contained in Spec-Data Sheet 7, Waterproofing, published in April 1971, by Standard Dry Wall Products, Inc.

The resultant sandwich-like construction has fire retardant properties suitable for use in commercial buildings as well as sound and energy sealing properties which make the units desirable for use in such buildings.

Figure 7:
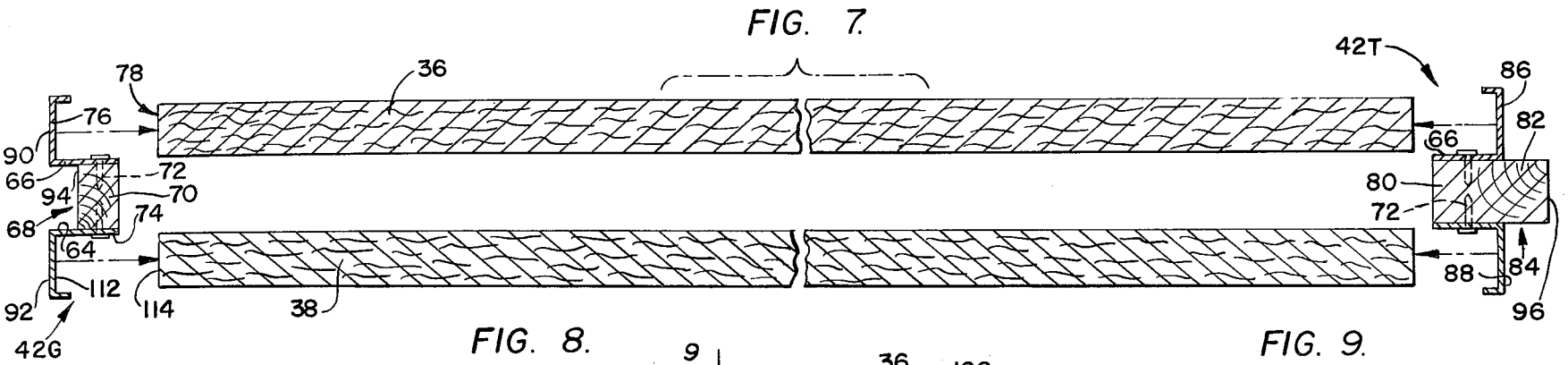
FIG. 7 is an exploded plan view of a panel embodying the teachings of the present invention.
Figure 9:
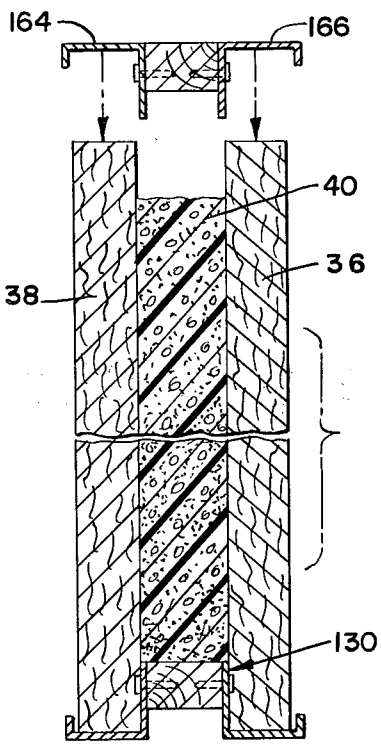
FIG. 9 is a sectional view along line 9—9 of FIG. 8.

As best shown in FIGS. 2 and 7, the frame elements 42 serve to fasten the panels of each unit together and to couple adjacent units together. The fasteners include a tongue forming cap 42T and a groove forming cap 42G. Each fastener includes a pair of J-shaped channels 60 having the rear faces 64 of the long legs 66 thereof presented toward each other to define a gap 68 therebetween. The groove forming fastener includes a groove bottom forming member 70 with penetrating fasteners, such as nails 72, attaching each channel to an end face 74 thereof. As shown in FIG. 7, when attached to the member 70, the bight section 76 of each of the channels 60 is presented to receive an edge 78 of one of the panels 36 and 38. The tongue fastener 42T is similar to the groove fastener 42G, except that a tongue forming member 80 replaces the bottom forming member 70. The tongue 80 has long facial sides 82 to which are attached long legs 66 of the channel members 60 by nails 72. A projecting portion 84 projects outwardly beyond the plane containing outer faces 86 and 88 of the bight sections of the channel member to form the tongue. The outer faces 90 and 92 of the groove forming channel members are also essentially co-planar, and the depth of gap 68 as measured from faces 90 and 92 to upper face 94 of the member 70 is slightly less than the height of the projection 84 as measured from faces 86 and 88 to outer face 96 of the projecting portion 84 so that the tongue and groove members can be matingly registered as shown in FIG. 2 with a sealer receiving space 98 defined therebetween when faces 94 and 96 are in abutting contact with each other. The faces 86, 88 and 90, 92 are located adjacent each other and form sealer receiving surfaces upon which the sealer is positioned, as by a caulking gun 100.

Figure 8:
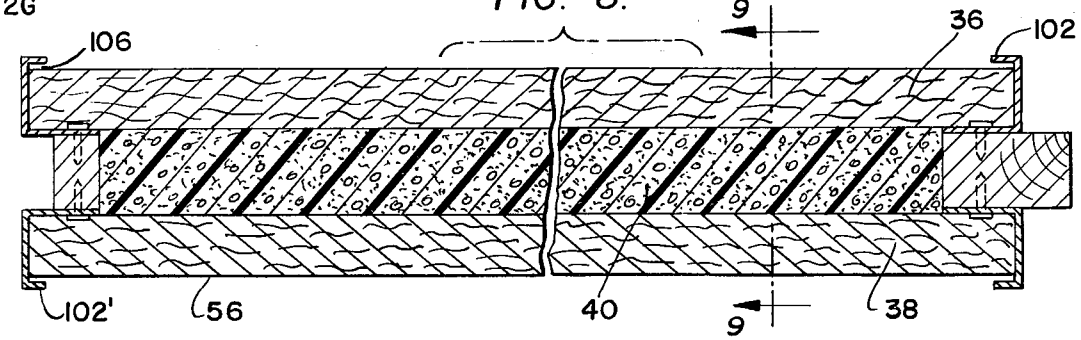
FIG. 8 is a plan view of a panel embodying the teachings of the present invention.
Figure 10:
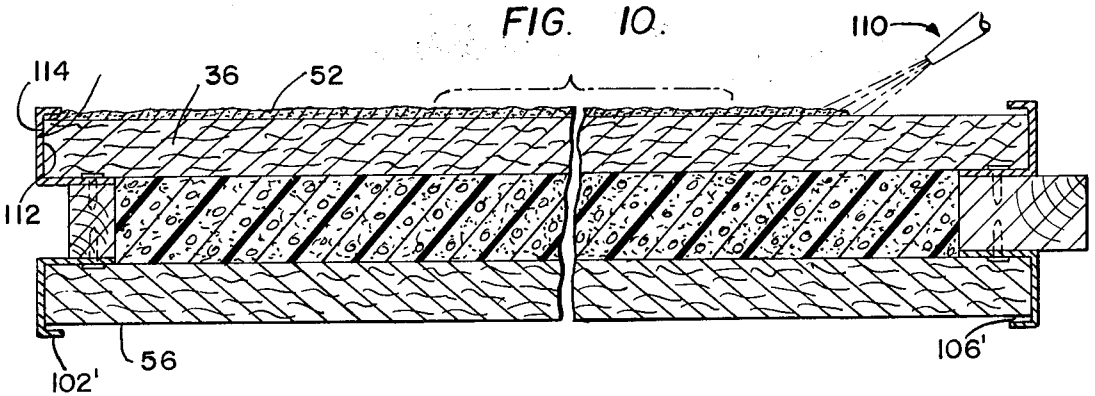
FIG. 10 is a plan view of a panel embodying the teachings of the present invention.

As shown in FIGS. 8 and 10, the width of the bight section of the channel connected to outer panel 36 slightly exceeds the thickness of that outer panel, so that flange member 102 is spaced apart from the outer face of the panel 36. The gap 106 thus defined has a transverse dimension sufficient to receive the layer of weatherproofing. The weatherproofing layer can be sprayed onto the outer face of the exterior panel 36 by a spray means 110 as shown in FIG. 10, and adheres thereto in the usual manner. Furthermore, a non-penetrating attaching means, such as adhesive, may be interposed between inner surface 112 of each channel member and outer surface 114 of each panel edge to thereby attach the panels to the channel members, which are attached to each other as above-discussed, thereby forming a unit.

Alternatively, the bight section of the channel contacting inner panel 38 can be dimensioned so that the inner flange 102' thereof is spaced apart from the inner face 56 of the inner panel 38. The gap 106' thus defined will receive a coating layer similar to outer layer 52, or a coating such as wall board, or the like, and fasten such layer to the inner panel 38. As will be discussed below, the preferred form of the present invention has the inner face 56 exposed to effect good acoustical properties.

As shown in FIG. 2, the bottom edge 130 of each unit comprises J-shaped channels 132 each having a bight section 134 connecting a flange 136 to a long leg 138 and having a width equal to the width of the above-discussed channels. Interfitting the bottom channels and the above-discussed side channels can be effected by various means, such as mitering, or offsetting the edges of the channels. For example, the long leg and flange of the bottom channels have end edges which are spaced longitudinally inward of the channel to define open spaces between the outer edge of the bight and the end edges. The width of the spaces equal the width of the long sides of the channels forming the fastener 42, and the outer flange members 102 and 102' respectively receive those long sides in a mating engagement. A bottom forming member 152 is attached to the long legs of the bottom channel in a manner similar to that above-discussed with reference to the panels 36 and 38. The member 152 extends the width of the unit and has ends positioned to be co-planar with faces 94 and 96 of the groove and tongue forming members respectively.

The bottom channel forms a groove which mates with a furring strip 160 and is attached thereto by an anchoring means, such as bolt 162, to attach the wall panel units to the building foundation, so that the bottom presented faces of the bottom fastener member are flushly mounted on the upper surface of the foundation or the flooring of the building. The top attaching means is similarly formed with gaps and the like, to interfit with the edge fastening means 42. Instead of groove forming elements, however, tongue forming elements are included to have a projection extending outwardly and upwardly from the unit. A full discussion of the top attaching means will not be presented in the interest of clarity, but that member has a tongue member similar to member 42T and a long leg similar to the long leg of the bottom member, and a flange member similar to the flanges of the bottom member to mate with the channel members of the end fasteners 42 in a manner similar to that of the abovediscussed bottom member.

As shown in FIG. 2, the units are stacked on top of each other to form the building walls, and due to the groove bottom and tongue forming members, is load bearing. The groove bottom and tongue forming members can be formed of usual wood stock, such as a two-by-four stud which is split to form the tongue and groove bottom members. As shown in FIG. 2, the units are assembled with the top tongue edge presented upwardly. To place the roof onto the wall forming units, the projection of the topmost tongue fastener is cut off to be flush with the co-planar faces 164 and 166 of the top forming channels. A top plate member 168 is secured to the co-planar faces 164 and 166 to form a seat to which the roof is attached. The roof load is thereby transmitted to both panels, tongue and groove members uniformly. The edgewise connection of the units aligns the wood stock members forming the tongues and grooves of stacked units in an end-to-end manner, thereby forming stud-like members which are load bearing elements to support the weight of the structure. The assembled walls thus form a building frame which is load bearing.

Figure 3:
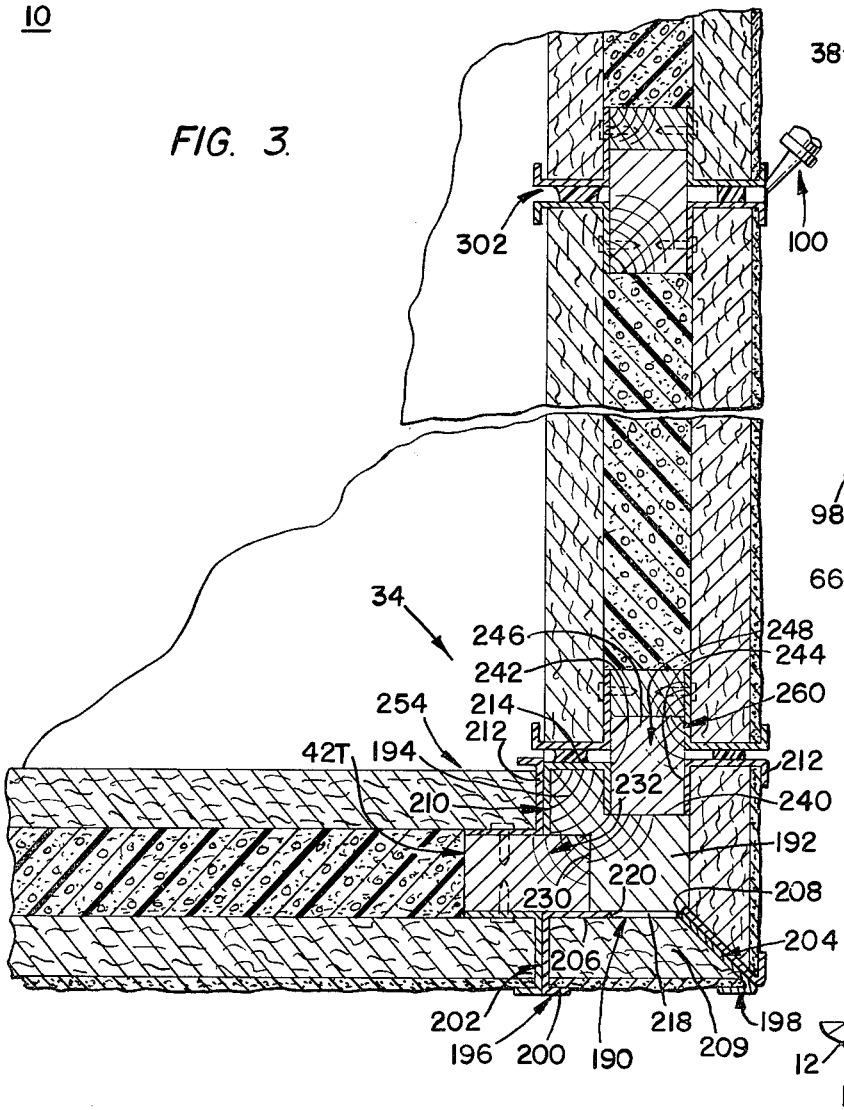
FIG. 3 is a fragmentary horizontal section along lin 3—3 of FIG. 1.

A corner element 34 is shown in FIG. 3 to include a central element 190 formed of two edge connected elements 192 and 194 connected together to form an integral element which has an hourglass-like shape in transverse cross section. Attached to the central element are channel members 196 and 198 which are each shaped to have an outer flange 200 and end edges 202 and 204, with an inturned flange 206 integrally attached to end edge 202 to be in spaced parallelism with outer flange 200. End 204 is angled inwardly of the member to define a beveled edge having a free end 208 located in the plane of flange 206. Corner panels 209, which are of the same construction as panels 36 and 38, are attached to the channel members in a manner similar to that discussed above with respect to panels 36 and 38 and the fastener 42. A fastener, such as adhesive, or nails, or the like, attaches the flanges 206 to the central element to form an outer corner. An inner J-shaped channel member 210 surrounds the free ends of the interior element 194 and has outwardly presented faces 212 and 214. A gap 218 is defined between edge 220 of the flange 206 and free end 208 of the end 204. The gap 218 can be filled with adhesive or foam, or left open, as desired.

Face 230 of the element 192 forms the bottom of a groove 232 having a depth corresponding to the depth of fastener 42G and into which a tongue of a fastener 42T fits to lock a wall unit to the corner unit as shown in FIG. 3. Face 240 of the element 192, and face 242 of the channel member 210, along with face 244 of the flange 212 forms a gap into which projecting member 246 is fit to form a tongue 248. The tongue cooperates with a groove 42G of a wall unit to attach that unit to the corner member.

As shown in FIG. 3, the tongue connecting unit has and end edge 254 in flush abutment with the groove defining end of the corner. A non-penetrating fastener, such as adhesive, can be interposed in the corner groove to attach the projection of the tongue to the corner, thereby connecting the unit to the corner. Alternatively, penetrating fasteners, such as nails, can be set into the channel flange 206 to connect that channel to the tongue forming projection prior to inserting the panels 209 into the channel. As also shown in FIG. 3, the tongue forming end of the corner element has a projection 260 which extends outwardly from the corner member farther than the depth of the fastener groove 42G to thereby form a sealer receiving gap between the panel and the corner member. A sealer is located in the just-discussed gap in a manner similar to the caulking 50 discussed above.

As above, the central element 190 can be formed of wood stock or other load bearing elements. A top cap similar to cap 168 can be placed over the top of the corner element, and the bottom thereof is shaped with channels similar to the bottom channels discussed above to seat and receive a furring strip in a manner similar to that discussed above with respect to bottom fastener 130. The bottom channel of the corner element has gaps, groove bottom forming means and flanges similar to the gaps, flanges and bottom forming means of the bottom fastener 130, and interlocks the furring strip in a manner similar to that of the fastener 130. The connected structure is, therefore, load bearing and is easily positioned and erected on building formation 12, or a floor of such a building.

The panel units can be formed in a variety of ways, shapes and sizes, and one method of forming units is illustrated in FIGS. 7–10. The illustrated method includes the steps of forming the fasteners 42G and 42T by connecting the J-shaped channel elements to the groove bottom forming member and to the tongue forming member, then securing the fasteners to the edges of the panels 36 and 38. The bottom connecting element 130 is then formed and the foam core is inserted, sprayed or frothed between the spaced apart panels. The top fastener is placed onto the unit to form a peripherally closed structure. The unit can be held in a jig during insertion of the foam and set-up thereof. The outer coating layer is then attached to the outer face of the outer panel, and the unit is complete.

A wall comprised of fully assembled panels is erected as shown in FIG. 4. The furring strip is connected to the floor to form an anchoring member, and a layer of adhesive 270 is positioned on the outwardly presented surfaces of the furring strip, and a unit is seated thereon. Adjacent units are similarly seated on the furring strip and moved into interconnecting contact with the previously seated units. The units are progressively seated on the furring strip, along with the corner sections, until a first, or bottom, row is completed. Adhesive is then placed on the upwardly presented tongues, and the next row of wall panel units is positioned on top of the just erected units. The erection continues until the walls are complete, at which time, the top fastener tongues of the top fasteners of the uppermost row are cut, and a top cap 168 is fastened to the units, and the building roof is completed in the usual manner.

A corner member is formed by attaching the channel members and the bottom fastening means to the central element.

Alternatively, the panel units can be shipped to the building site as separate elements and the panel units erected in situ. Such a method includes the steps of attaching the furring strip to the foundation, and attaching the formed bottom channels thereto. The end channels are formed and attached to the bottom channels by adhesive, or other suitable fastening means, and the panels 36 and 38 are slipped into registry with the channels. Corners are formed and attached to the furring strip at appropriate locations and attached to fasteners 42 as required. The foam-like core is placed between the panels, and the top attaching means is placed on the panels to form the first, or bottom row of units. Again, jigs can be used while the foam is being inserted and set-up.

The next row is connected to the bottom row, with the bottom fasteners being attached to the outwardly projecting tongues of the top fasteners in a manner similar to the attachment of the bottom fastener to the furring, or anchoring strip, using adhesive means, or penetrating fasteners are required.

The wall rows are assembled and interconnected in the above-discussed manner until the wall is completed. The tongue of the uppermost panel top fastener is cut, and top cap 168 is attached to that unit, after which, the building roof is assembled and supported on the wall in the usual manner.

It is here noted that windows, doors and other openings are fashioned by positioning the units to define the appropriate openings, and the panels can be manufactured in a wide variety of sizes.

Once a wall is completed, the inner faces 56 of the panels can be covered, or left exposed, as desired. In the preferred form, the PetriCal panels exhibit such excellent sound absorbing characteristics that it is desirable to leave such panels exposed. If the panels are left exposed, the bight sections of the J-shaped channels may be sized so that the flange portions 102' thereof are seated against the panel inner faces 56. The uncovered surface is therefore an exposed fibrous acoustical surface.

If the wall constructed using the units of the present invention is to be used in an area where people or objects may contact surfaces 56, such as a hallway, or the like, that surface can be covered. The Thoroseal coating which forms outer layer 52 is suitable for use as an inner covering also. However, other wall coverings, such as wall board, and the like, are also suitable.

As shown in FIGS. 2 and 3, gaps 98 and 302 are formed between adjacent units. These gaps can be used as raceways for electrical wires or the like. If desired, decorative strips can be inserted in the inside gaps to cover same. The decorative strips can be used in place of sealer 50, or over that sealer, as desired.

An alternative embodiment of the present invention is shown in FIG. 6 and is denoted generally by the numeral 26'. The alternative embodiment includes abutments joints 280 comprised of cross members 282 and 284 nailed, or otherwise attached, to end attaching members 286 and 288 of the unit 26'. A pair of interposer members 290 and 292 are located between the cross members, and a pair of U-shaped clamp members 294 and 296 are nailed, or otherwise attached, to the cross members to connect the two members together, and hence connect adjacent units 26' together. The outer and inner layers are then placed on the exterior and interior faces of the panels, as above-discussed.

The units 26' are formed by gluing end edges 310 and 312 of the panels 36' and 38', respectively, to the cross brace, or by gluing the panels to the attaching members along inner surfaces 314 and 316 of the panels. The foam also acts as an attaching means for coupling the panels together.

The unit 26' can be formed and shipped to the building site, or shipped to the building site and formed in situ, in a manner similar to that discussed above with reference to the preferred embodiment.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as cojointly cooperative equivalents are, therefore, intended to be embraced by those claims.

We claim:

1. A plurality of engageable load bearing panel units for a wall, each panel unit comprising:

co-extensive inner and outer panels, each panel comprising chemically treated wood fibers which have been mixed with cement and bound together under pressure then cured and kiln dried;

a core of urethane foam connecting said panels together;

groove edge fastening means located on first peripheral edges of said panels;

tongue fastening means located on second peripheral edges of said panels; and additional groove fastening means located on a third peripheral edge of said panels, and additional tongue fastening means located on a fourth peripheral edge of said panels so that each panel unit is engageable with another panel unit to form a stacked configuration, said fastening means each including a pair of J-shaped channel members each having a long side and a short side, with the long sides of the J-shaped members being located between the short sides of said J-shaped members.

2. The load bearing panel unit of claim 1, wherein said J-shaped channel members are oriented so that said long sides are presented toward each other.

3. The load bearing panel unit of claim 2, wherein said groove fastening means each includes a groove bottom forming member connected to said J-shaped channel long sides to be located adjacent the ends of said channel members which are remote from said bight sections.

4. The load bearing panel unit of claim 3, wherein said tongue fastening means each includes a tongue forming member attached to said channel member long sides and projecting outwardly beyond the bight sections of said channel members.

5. The load bearing panel unit of claim 4, wherein said tongue forming member and said groove bottom forming member are formed of wood, and said tongue forming member projects outwardly beyond said bight portions a distance slightly greater than the distance between said bight portions and said groove bottom forming member.

6. The load bearing panel unit of claim 1, further including a weathertight seal positioned on said outer panel.

7. The load bearing panel unit of claim 1, wherein said core comprises urethane foam.

8. The load bearing panel unit of claim 1, wherein one of said groove fastening means is located on the bottom of the panels, and further including a furring strip located on a building foundation for cooperation with said bottom groove fastening means.

9. The load bearing panel unit of claim 2, further including sealer means positioned on said channel member bight portions.

10. The load bearing panel unit of claim 1, further including a covering material located on said inner panel.

11. The load bearing panel unit of claim 1, further including cross membes and wood inserts on said panel units to which said cross members are attached.

12. The load bearing panel unit of claim 11, further including spacer members attached to said cross members.

13. The load bearing panel unit of claim 12, further including a cap connecting cross members of adjacent panel units together.

14. The load bearing panel unit of claim 13, wherein said cap is U-shaped.

15. The load bearing panel unit of claim 1, wherein said panels include cementitious materials.

16. The load bearing panel unit of claim 1, wherein said core includes polyurethane foam.

17. A method of forming a load bearing wall panel unit comprising the steps of:

attaching a pair of J-shaped channel members to a groove bottom forming member to form a groove;

attaching another pair of J-shaped channel members to a tongue forming member to form a tongue fastening member;

attaching a third pair of J-shaped channel members to another groove bottom member forming element to form a bottom groove fastening means;

attaching said first groove fastened means and said tongue fastening means to said bottom groove fastening means at opposite ends thereof;

inserting a pair of acoustical wall panels into the channel members forming said first groove fastening member and said tongue fastening member so that said panels are in spaced parallelism with respect to each other to define a gap therebetween;

inserting a foam-like material into said gap;

forming a top tongue fastening member by attaching a fourth pair of J-shaped channel members to a tongue forming member; and attaching said top tongue fastening member to said spaced apart panels.

18. The method of claim 17, further including a step mounting the load bearing wall panel unit on a building foundation.

19. The method of claim 18, further including a step of mounting a plurality of wall panel units in a stacked end-to-end configuration.

20. A method of erecting a building wall including the steps of:

mounting a furring strip on a foundation of the building;

covering said furring strip with an adhesive material;

forming a bottom groove fastening member by attaching a first pair of J-shaped channel members to a first groove bottom forming member;

attaching said bottom groove fastening member to said furring strip;

forming an end edge groove fastening member by attaching a second pair of J-shaped channel members to a second groove bottom forming member to form a groove;

attaching said end groove fastening member to said bottom groove fastening member to be in an upright orientation at one end of said bottom groove fastening member;

forming an end edge tongue fastening member by attaching a third pair of J-shaped channel members to a tongue forming element to form a tongue;

attaching said end edge tongue fastening member to another end of said bottom groove fastening member at one end thereof to be essentially upright therefrom;

mounting a pair of panels on said fastening members to be in spaced parallelism and to be in an upright orientation with a gap defined therebetween;

filling said gap with a foam-like material;

forming a top tongue fastening member by attaching a fourth pair of J-shaped panel members to a second tongue member to form a tongue; and attaching said top tongue fastening member to said panels.

21. The method of claim 20, further including attaching a plurality of wall units together with an end edge tongue of one unit engaged in an end edge groove of an adjacent unit.

22. The method of claim 21, further including a step of cutting off said top tongue element to be flush with the top edges of said panels, and placing a top weight distributing cap on said panels.

23. The method of claim 22, further including mounting roof members on said top cap.

24. The method of claim 20, further including a step of placing a second row of panels on top of the panels attached to said furring strip.

* * * * *